United States Patent [19]

Tatsuguchi

[11] Patent Number: 4,662,787

[45] Date of Patent: May 5, 1987

[54] LOCKING DEVICE FOR LOCKING OFF-SHORE WORK PLATFORM TO LEG CHORD USED FOR LIFTING WORK PLATFORM

[75] Inventor: Masamitsu Tatsuguchi, Saitama, Japan

[73] Assignee: Mitsui Ocean Development & Engineering Co., Ltd., Tokyo, Japan

[21] Appl. No.: 730,782

[22] Filed: May 6, 1985

[30] Foreign Application Priority Data

May 17, 1984 [JP] Japan ..... 59-97518

[51] Int. Cl.[4] ..... E02B 17/06

[52] U.S. Cl. ..... 405/198; 254/95

[58] Field of Search ..... 405/196, 197, 198, 199, 405/200; 254/95

[56] References Cited

U.S. PATENT DOCUMENTS 4,389,140 6/1983 Bordes ..... 405/198 X
4,431,343 2/1984 Uchiyama ..... 405/198
4,479,401 10/1984 Korkut ..... 405/198 X

FOREIGN PATENT DOCUMENTS 76318 5/1984 Japan ..... 405/198

*Primary Examiner*—David H. Corbin
*Attorney, Agent, or Firm*—Dann, Dorfman, Herrell and Skillman

[57] ABSTRACT

A device for locking the vertical position of a leg relative to an off-shore work platform having a vertical rack with angular teeth and a lock body with mating angular teeth. The lock body is positioned between a pair of upper and lower wedge members adapted to slidably engage a horizontal face on one side and an inclined face on the other side. The inclined faces of the upper and lower blocks are in opposed directions parallel to the pressure faces of the teeth of the rack and block body. The wedge blocks are adapted to be displaced horizontally in coordination so that when moved simultaneously, a horizontal displacement of the lock body occurs, and when one is moved without the other, an angular displacement of the lock body parallel to the pressure surface of the meshing teeth of the rack is obtained.

6 Claims, 2 Drawing Figures

LOCKING DEVICE FOR LOCKING OFF-SHORE WORK PLATFORM TO LEG CHORD USED FOR LIFTING WORK PLATFORM

FIELD OF THE INYENTION

The invention relates to a locking device for attaching firmly to a vertical leg chord , an off-shore work platform constructed upon a hull and used for drilling seabed oil wells, civil engineering works below the seabed, etc., so as to withstand the forces of high waves and strong winds, and more particularly to a device comprising a rack mounted longitudinally onto a leg chord to be used for lifting up or lowering the off-shore work platform, a lock body that engages or disengages the rack, and means to lock the teeth of the lock body to the rack which enables the operation of displacing the lock teeth and positioning them for meshing relative to the rack simply and reliably.

BACKGROUND OF THE INVENTION

Hulls with an off-shore work platform usually have a polygonal shape and from three to four vertical leg chords that are connected by truss work and that penetrate through the hull. Those chords can be lifted up or lowered relative to the hull.

As schematically shown in FIG. 2 in the accompanying drawing, the invention may be applied to a platform in which a longitudinal rack 3 is fixed on a vertical leg chord 2 that penetrates through the hull 1. On this hull the off-shore work platform is mounted. The rack 2 meshes with a plurality of pinions 5 mounted on a support frame 4 on the hull 1. When the pinions 5 are driven by a driving means 6 that is provided on the support frame 4, the leg chord 2 ascends or descends relative to the hull 1. After the bottom end of the leg chord touches the seabed, if the leg chord is further driven downward into the seabed, the hull 1 is raised off the surface of the sea 7 as shown in FIG. 2. Then the off-shore work platform can be raised to a desired from the surface of the sea 7 by driving the pinions 5 after the bottom end of the leg chord has been firmly embedded in the seabed.

One device to lock the off-shore work platform which has been positioned at a desired height is disclosed in U.S. Pat. No. 4,389,140. According to this patent, a wedge-shaped rack piece with a plurality of locking teeth is mounted on the hull in such a fashion that those locking teeth can either engage the rack on the leg chord or disengage it if desired. The locking teeth of the rack piece lock the hull by engaging the rack. The positioning of the engagement of the locking teeth with the rack can be adjusted by lifting up or lowering a guide block which has wedge faces. The guide block is moved by turning screw spindles which are mounted on the upper and lower sections of the rack piece.

Such conventional locking devices have some disadvantages. When an off-shore work platform is supported and fixed by a leg chord, the vertical load on the chord concentrates on the upper support face or on the lower support face of the rack piece, and the above mentioned means of positioning the engagement of the rack piece with the rack on the chord, that is, the screw spindles are often subjected to an overload. This load is liable to damage the screw spindles and also much effort is required to properly position the guide block for meshing the teeth of the rack piece with the rack.

SUMMARY OF THE INVENTION

An object of the present invention is to eliminate the disadvantages of conventional locking devices. Another object of the invention is to provide a locking device for leg chords used for off-shore platforms, which makes the engagement operation for the rack and locking device as easy as possible. The means for positioning and engagement of a lock body with the rack is mounted at one side of the lock body. An embodiment of the invention will be explained in reference to the attached drawings.

DESCRIPTION OF THE PREFERRED EMBODIMENT

Figure 1:
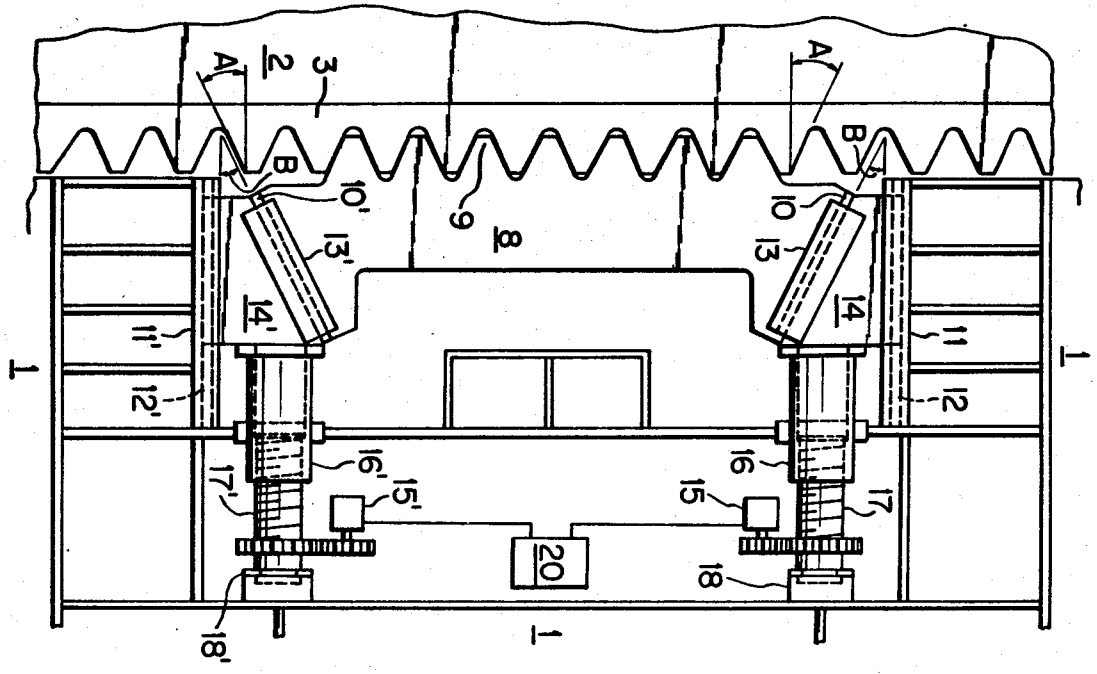
FIG. 1 is an enlarged view showing the essential portions of a preferred embodiment of the invention having a locking body with teeth for locking and holding a hull in proper position on a vertical leg chord.
Figure 2:
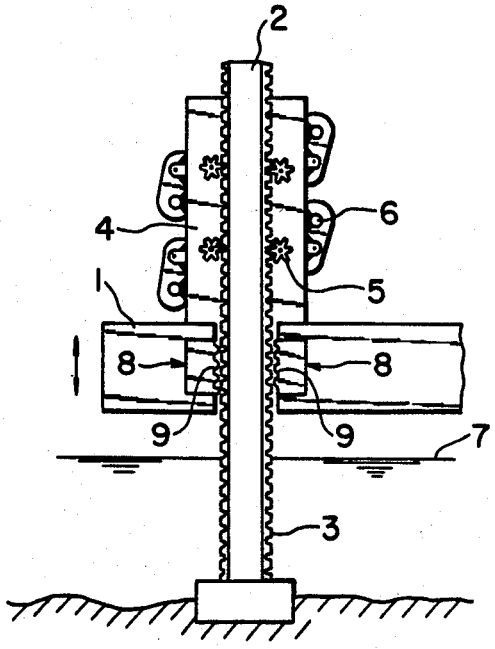
FIG. 2 is an enlarged overall schematic view to show the relation between a hull with an off-shore work platform and a device to lift or lower a vertical leg chord.

FIG. 1 is a view which enlarges essential portions of an embodiment of the invention. In FIG. 1, a vertical leg chord 2 penetrates through a hull 1. A rack 3 is mounted on the leg chord. A lock body 8 which is mounted on the hull 1 has many locking teeth 9. Those teeth engage the rack 3. As shown, the teeth of the rack 3 mate with the teeth of the lock body 8, both teeth being of conventional angular screw thread form. The upper and lower end faces 10 and 10′ of the lock body 8 form wedge faces on which guide rails 13 and 13′ respectively are mounted. The guide rails 13 and 13′ confront guide rails 12 and 12′ respectively which are mounted on bearing faces 11 and 11′ provided on the hull 1. The end face 10 confronts the bearing face 11 and the end face 10′ confronts the bearing face 11′. The end and bearing faces fbrm upper and lower pairs of confronting faces which converge toward each other in the direction of the rack 3.

Upper and lower wedge blocks 14 and 14′ are inserted from the side of the lock body 8 between the upper pair of confronting faces 10 and 11 and between the lower pair of confronting faces 10′ and 11′. The wedge blocks 14 and 14′ slide and fit on the guide rails 12 and 13 and on the guide rails 12′ and 13′ respectively, which are constructed and arranged to maintain the wedge blocks 14 in flush slidable engagement with the associated pair of confronting faces. The wedge blocks 14 and 14′ are fixed respectively on the ends of nut members 16 and 16′ which engage respectively screw shafts 17 and 17′ and move back and forth horizontally. The shafts 17 and 17′ are rotated respectively by motors 15 and 15′. The motors 15 and 15′ are independent and their actuation is adapted to be coordinated through a control device 20. The screw shafts 17 and 17′ are rotatably supported in bearing members 18 and 18′ respectively. The wedge angle B between the engaging surfaces of the wedge blocks 14 and 14′ is equal to the pressure angle A of the rack. The pressure angle is the angle which the angled faces of the rack teeth make with the horizontal.

The device to insert the wedge blocks or to pull them out is not limited to the above-mentioned screw shafts.

Hydraulic cylinders and other well-known drive means can be used, and the inclined wedge faces could be provided on the bearing faces 11 and 11' instead of on the end faces 10 and 10'.

The operation to lock the leg chord will now be explained. When the lock body 8 is in the withdrawn position from the rack 3 on the leg chord 2 and the locking teeth 9 are displaced from the rack 3, the hull 1 or the off-shore platform is positioned at a desired height relative to the surface 7 of the sea by either lifting it up or pulling it down by rotation of the pinions 5 which mesh with the teeth of the rack 3. The displacement of the lock body is such that the rack 3 and the locking teeth 9 of the lock body 8 are close to their desired meshing position, that is, the tips of the rack and the locking teeth mutually face but do not abut against each other, nor interfere with the longitudinal displacement of the hull 1 relative to the rack.

Next the motors 15 and 15' are both actuated in coordination so that the screw shafts 17 and 17' are rotated simultaneously to advance the nut sections 16 and 16' in order to make the locking teeth 9 and the rack mesh together. Rotation of the two screw means displaces the two wedge blocks 14 and 14' along the bearing faces 11 and 11' of the associated pair of confronting faces, and generates a force component on the opposite face of each wedge block perpendicular to that face, by reason of the slidable flush engagement of the block against the face. The forces against the upper and lower end faces 10 and 10' of the lock body combine to cancel out the vertical components of the two forces and provide a resultant horizontal force displacing the lock body toward the rack so as to initiate meshing of the lock body with the teeth of the rack.

At this time the meshing of the teeth of the rack 3 and the locking teeth 9 often cannot be complete because the teeth are not in precise vertical registry. In such case, in order to achieve full precise vertical registry and thereby full meshing, the locking teeth 9 are displaced vertically and advanced horizontally in small increments by horizontally advancing one of the wedge blocks 14 and 14' with the other wedge block being not moved. Advancing the wedge block 14' while holding the block 14 stationary causes the force component from the wedge 14' to displace the lock body 8 slidably along the end face 10 to displace the teeth upwardly and inwardly parallel to the end face 10. Conversely, advancing the wedge block 14 while holding the block 14' stationary will cause the lock body 8 to slide along its lower end face 10' and displace the teeth downwardly and inwardly parallel to the end face 10'.

When both wedge blocks are moved simultaneously by the control means 20, the lock body is subjected to opposed forces from the upper and lower wedge blocks which provide a resultant horizontal force advancing the lock body 8 to the left. When one motor is stopped and the other actuated by the control means 20, the lock body 8 is moved angularly parallel to one or the other of the end faces 10 and 10'. By coordinating the motors 15 and 15' the angular displacement of the lock body may be varied as desired in order to obtain precise vertical registry of the teeth on the lock body with the teeth of the reck. The degree of vertical displacement is determined by the relative displacement between the upper and lower wedge blocks.

Thus it is always possible to correct the meshing of the locking teeth 9 and the rack 3 when it is not correct by horizontally pushing forward or pulling back either one of the wedge blocks 14 and 14' independently. It should be noted that one face of each confronting face pair is horizontal and the other is at an angle B to the horizontal. Since the angle B has been made equal to the pressure angle A of the rack, when the lock body is first advanced horizontally to cause the tip of the teeth to engage the pressure face of the rack, it will meet with resistance to further horizontal movement. Thereupon, the appropriate one of the upper and lower wedge blocks may be arrested and displacement of the other of the wedge, blocks will cause the lock body to move parallel to the pressure surface of the rack tooth. Thus, the locking action does not require vertical displacement of the rack to assure full meshing of the lock body teeth with the rack teeth. If desired, the control means may include a sensor for determining the resistance to horizontal displacment of the lock body 8 along with automatic means to stop actuation of the appropriate drive motor to drive the lock body angularly along the pressure surface.

As explained above, the invention provides an upper wedge block and a lower wedge block as means for meshing and positioning the lock body relative to the rack, both wedge blocks playing the role of bearing the lock body at its upper and lower faces. The invention also provides screw shafts and motors for moving the wedge blocks forward or backward and adjusting their position at the side of the lock body with the result that the component forces exerted on those means to move the wedge blocks for locking the off-shore platform to the leg chord in relation to the total vertical load carried by the pinions 5 are reduced a great deal. There is, therefore, no possibility that those means will be damaged, and very smooth locking can be accomplished by the invention.

Off-shore platforms can be easily set up so as to withstand strong winds and high waves. The locking means according to the invention are successfully applicable also to drilling deep-sea seabed oil wells, civil engineering works under the seabed, etc.

While a particular embodiment of the present invention has been herein illustrated and described, it is not intended to limit the invention to such disclosure, but changes and modifications may be made therein and therto within the scope of the following claims.

I claim:

1. A device for lifting up or lowering down a hull with an off-shore work platform comprising a toothed rack having a longitudinal axis and fixed longitudinally onto an upright leg extending through said hull, a driving pinion mounted on said hull, said rack and said driving pinion meshing together, means to rotate said pinion relative to said rack to effect relative displacement along the longitudinal axis of said rack to thereby move said hull up and down, a lock body having upper and lower end faces and a plurality of teeth between said faces adapted to engage or disengage said rack, upper and lower bearing faces in said hull confronting said upper and lower end faces respectively, said upper end face and upper bearing face comprising an upper pair of converging faces and said lower end face and said lower bearing face comprising a lower pair of converging faces, in each pair said converging faces converging toward each other at a selected wedge angle, one face of each pair being perpendicular to the longitudinal axis of said rack, a wedge block positioned between each pair of confronting faces and slidable therealong, guide means coupling said wedge blocks to said lock body and said hull to afford movement of said lock body relative to said hull in plural directions including directions respectively parallel to and perpendicular to said longitudinal axis, and separate drive means for each wedge block provided at the side of said lock body to move its associated wedge block back and forth along said perpendicular face to thereby produce a force component on said lock body perpendicular to the other of said confronting faces, and means for coordinating said separate drive means to displace the lock body in at least one of said plural directions so as to move the teeth of said lock body into and out of meshing relation with said toothed rack, and in another of said plural direction to displace said body parallel to said longitudinal axis.

2. A device according to claim 1 wherein said tooth rack has angular screw-thread teeth and said lock body has corresponding angular teeth, one of the angular surfaces of said teeth being parallel to said other converging face of one pair and the other of the angular surfaces of said teeth being parallel to said other converging face of the other pair, so that said lock body may slide into full meshing engagement with said toothed rack in the direction parallel to one of said angular tooth surfaces while sliding along said other face which is parallel to said angular tooth surface.

3. A device according to claim 1 wherein said rack is disposed vertically along said leg, said perpendicular face in each pair being disposed horizontal, the other of said converging faces in the upper pair being inclined upwardly toward said rack and the other of said converging faces in the lower pair being inclined downwardly toward said rack, said drive means when operated to push both of said upper and lower wedge blocks horizontally toward said rack thereby being effective to force said lock body horizontally toward said rack and when operated to push only one of said upper and lower wedge blocks horizontally toward the rack thereby being effective to force said lock body to slide along the inclined bearing surface of the other of said upper and lower wedge blocks, whereby equal horizontal displacement of said upper and lower wedge blocks causes horizontal displacement of said lock body and when one wedge block is horizontally displaced more than the other, it effects both horizontal and vertical displacement of the lock body.

4. A device according to claim 1 wherein said rack is disposed vertically along said leg, the perpendicular face in each pair being disposed horizontal, the other face in the upper pair being inclined upwardly toward said rack and the other face in the lower pair being inclined downwardly toward said rack.

5. A device according to claim 1 wherein each of said converging faces has guide rail means to maintain each of said wedge in blocks in flush slidable engagement with the associated pair of converging faces to comprise said guide means coupling said wedge blocks to said lock body and said hull.

6. A device according to claim 1 wherein said drive means comprises a single screw means for displacing each of the wedge blocks, said screw means having a rotary axis intersecting the longitudinal axis of said rack, and an individual motor for rotating each of said screw means, and wherein said means for coordinating said separate drive means comprises a control device for coordinating the actuation of said motors.

* * * * *